US005537941A

United States Patent [19]

Goidich

[11] Patent Number: 5,537,941

[45] Date of Patent: Jul. 23, 1996

[54] PRESSURIZED FLUIDIZED BED COMBUSTION SYSTEM AND METHOD WITH INTEGRAL RECYCLE HEAT EXCHANGER

[75] Inventor: Stephen J. Goidich, Palmerton, Pa.

[73] Assignee: Foster Wheeler Energy Corporation, Clinton, N.J.

[21] Appl. No.: 338,307

[22] Filed: Nov. 14, 1994

Related U.S. Application Data

[63] Continuation-in-part of Ser. No. 234,032, Apr. 28, 1994, abandoned.

[51] Int. Cl.[6] ..... F27B 15/02

[52] U.S. Cl. ..... 110/348; 110/216; 110/263; 110/304; 122/4 D; 422/145; 422/146

[58] Field of Search ..... 122/4 D; 165/104.16; 422/145, 146; 110/216, 245, 348, 263, 216, 304

[56] References Cited

U.S. PATENT DOCUMENTS

| | | |
|---|---|---|
| 4,165,717 | 8/1979 | Reh et al. . |
| 4,469,050 | 9/1984 | Korenberg . |
| 4,548,138 | 10/1985 | Korenberg . |
| 4,594,967 | 6/1986 | Wolowodiuk . |
| 4,617,877 | 10/1986 | Gamble . |
| 4,665,864 | 5/1987 | Seshamani et al. . |
| 4,682,567 | 7/1987 | Garcia-Mallol et al. . |
| 4,694,758 | 9/1987 | Gorzegno et al. . |
| 4,709,662 | 12/1987 | Rawdon et al. . |
| 4,716,856 | 1/1988 | Beisswenger et al. . |
| 4,761,131 | 8/1988 | Abdulally . |
| 4,813,479 | 3/1989 | Wahlgren . |
| 4,827,723 | 5/1989 | Engstrom et al. . |
| 4,896,717 | 1/1990 | Campbell, Jr. et al. . |
| 4,955,295 | 9/1990 | Abdulally . |
| 5,040,492 | 8/1991 | Dietz . |
| 5,054,436 | 10/1991 | Dietz . |
| 5,069,170 | 12/1991 | Gorzegno et al. . |
| 5,069,171 | 12/1991 | Hansen et al. . |
| 5,133,943 | 7/1992 | Abdulally . |
| 5,140,950 | 8/1992 | Abdulally . |
| 5,141,047 | 8/1992 | Geoffroy . |
| 5,141,708 | 8/1992 | Campbell, Jr. et al. . |
| 5,273,000 | 12/1993 | Regan . |

*Primary Examiner*—Henry A. Bennett
*Assistant Examiner*—Susanne C. Tinker
*Attorney, Agent, or Firm*—Haynes & Boone; Warren B. Kice

[57] ABSTRACT

A fluidized bed combustion system and method in which a recycle heat exchanger is disposed integrally with the furnace of a fluidized bed combustor. The recycle heat exchanger includes a plurality of stacked sections for receiving the recycled solids and are arranged in such a manner that the recycled solids are introduced into an upper level of the sections and pass through these sections to a lower level of sections before returning to the furnace. A portion of the stacked sections contain heat exchange surfaces for removing heat from the solids therein while another portion does not. The solids in the various sections are selectively fluidized to control the flow of the solids through the sections to control the temperature of the solids accordingly.

8 Claims, 2 Drawing Sheets

PRESSURIZED FLUIDIZED BED COMBUSTION SYSTEM AND METHOD WITH INTEGRAL RECYCLE HEAT EXCHANGER

CROSS REFERENCE TO RELATED APPLICATIONS

This application is a continuation-in-part of abandoned U.S. application Ser. No. 08/234,032, filed Apr. 28, 1994, for Pressurized Fluidized Bed Combustion System and Method with Integral Recycle Heat Exchanger, incorporated herein by reference.

BACKGROUND OF THE INVENTION

This invention relates to a pressurized fluidized bed combustion system and method and, more particularly, to such a system incorporating a integral heat exchanger for recycling solids from the combustor.

According to prior art fluidized bed combustion systems and methods, air is passed through a bed of particulate material, including a fossil fuel, such as coal, and a sorbent for the oxides of sulfur generated as a result of combustion of the coal, to fluidize the bed and to promote the combustion at a relatively low temperature. These types of systems are often used in steam generators in which water is passed in a heat exchange relationship to the fluidized bed to generate steam and permit high combustion efficiency, fuel flexibility, high sulfur adsorption and low nitrogen oxides emissions. These types of systems often utilize a "circulating" fluidized bed in which the entrained solid particles of fuel and sorbent (hereinafter referred to as "solids") from the furnace are separated from the mixture of fluidizing air and combustion gases (hereinafter referred to as "flue gases") and are recycled back to the furnace.

In these circulating beds, the fluidized bed density is relatively low when compared to other types of fluidized beds, the fluidizing air velocity is relatively high, and the flue gases passing through the bed entrain a substantial amount of the fine solids to the extent that they are substantially saturated therewith.

The relative high solids recycling is achieved by disposing a cyclone separator at the furnace section outlet to receive the flue gases, and the solids entrained thereby, from the fluidized bed. The solids are separated from the flue gases in the separator and the flue gases are passed to a heat recovery area while the solids are recycled back to the furnace. This recycling improves the efficiency of the separator, and the resulting increase in the efficient use of sulfur adsorbent and fuel residence times reduces the adsorbent and fuel consumption. Also, the relatively high internal and external solids recycling makes the circulating bed relative insensitive to fuel heat release patterns, thus minimizing temperature variations and, therefore stabilizing the sulfur emissions at a low level.

When the circulating fluidized bed combustors are utilized in a steam generating system, the combustor is usually in the form of a conventional, water-cooled enclosure formed by a welded tube and membrane construction so that water and steam can be circulated through the wall tubes to remove heat from the combustor. However, in order to achieve optimum fuel burn-up and emissions control, additional heat must be removed from the system. This heat removal has been achieved in the past by several techniques. For example, the height of the furnace has been increased or heat exchange surfaces have been provided in the upper furnace to cool the entrained solids before they are removed from the furnace, separated from the flue gases and returned to the furnace. However these techniques are expensive and the heat exchange surfaces are wear-prone. Other techniques involve the deployment of an additional, separate heat exchanger between the outlet of the separator and the recycle inlet of the furnace. Although heat can be removed from the recycled solids in this separate heat exchanger before the solids are passed back into the furnace, these type of arrangements are not without problems. For example, it is difficult to precisely control the heat transfer rates in the recycle heat exchanger. Also, during startup or load low conditions, it is often difficult to bypass the heat exchange surfaces in the recycle heat exchanger. Further, in situations when the recycle heat exchanger is formed integrally with the furnace, there is often an increase in boiler plan area which adds to the cost of the system.

SUMMARY OF THE INVENTION

It is therefore an object of the present invention to provide a fluidized bed combustion system in which a recycle heat exchanger is provided to remove heat from the recycled solids.

It is a further object of the present invention to provide a fluidized bed combustion system of the above type in which the amount of heat removed from the recycled solids can be precisely controlled.

It is a still further object of the present invention to provide a fluidized bed combustion system of the above type in which the recycle heat exchanger can be bypassed during startup and low load conditions.

It is a still further object of the present invention to provide a fluidized bed combustion system of the above type in which a pressurized system utilizing an outer pressure vessel is utilized to enable the above to be achieved without an increase in the size of the enclosing pressure vessel.

Towards the fulfillment of these and other objects, the fluidized bed combustion system of the present invention features a recycle heat exchanger disposed adjacent the furnace of a fluidized bed combustor. The recycle heat exchanger includes a plurality of stacked sections for receiving the recycled solids and cooling the solids. The heat exchanger sections are arranged in such a manner that the recycled solids are introduced into an upper level of the sections and pass through these sections to a lower level of sections before returning to the furnace.

BRIEF DESCRIPTION OF THE DRAWINGS

The above objects and summary, as well as further objects, features and advantages of the present invention will be more fully appreciated by reference to the following detailed description of the presently preferred, but nevertheless illustrative, embodiments of the present invention when taken in conjunction with the accompanying drawings wherein.

DESCRIPTION OF THE PREFERRED EMBODIMENT

Figure 1:
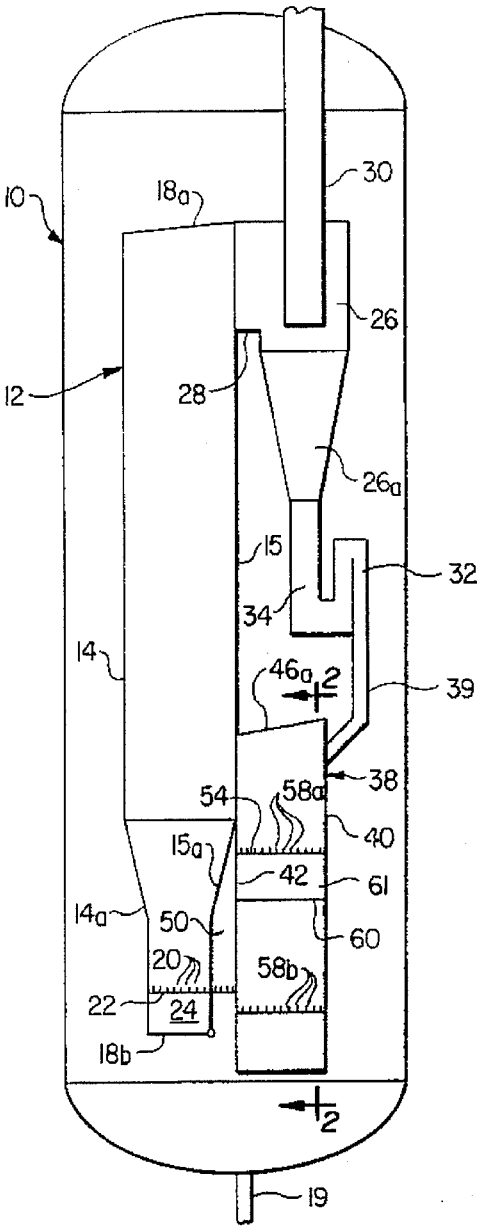
FIG. 1 is a schematic representation depicting the combustion system of the present invention.
Figure 3:
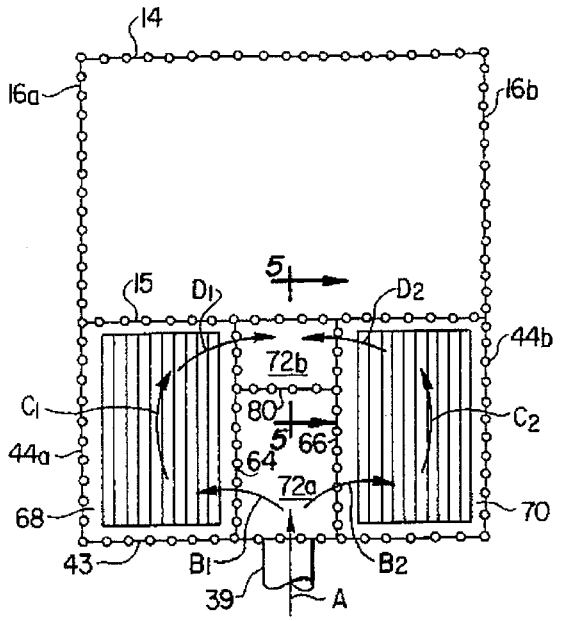
FIGS. 3 and 4 are cross-sectional views taken along the lines 3—3 and 4—4, respectively, of FIG. 2.

The drawings depict the fluidized bed combustion system of the present invention used for the generation of steam and including an upright pressure vessel 10 in which is disposed a water-cooled furnace enclosure, referred to in general by the reference numeral 12. The furnace enclosure 12 includes a front wall 14, a rear wall 15 and two sidewalls 16*a* and 16*b* (FIG. 3). As shown in FIG. 1, the lower portions 14*a* and 15*a* of the walls 14 and 15, respectively, converge inwardly for reasons to be explained. The upper portion of the enclosure 12 is enclosed by a roof 18*a* and a floor 18*b* defines the lower boundary of the enclosure. An air inlet duct 19 connects to the lower portion of the pressure vessel 10 for introducing pressurized air from an external source, such as a compressor driven by a gas turbine or the like.

A plurality of air distributor nozzles 20 are mounted in corresponding openings formed in a horizontal plate 22 extending across the lower portion of the enclosure 12. The plate 22 is spaced from the floor 18 to define an air plenum 24 which is adapted to receive air contained in the vessel 10 and selectively distribute the air through the plate 22 and to portions of the enclosure 12, as will be described.

It is understood that a fuel feeder system (not shown) is provided for introducing particulate material including fuel into the enclosure. The particulate material is fluidized by the air from the plenum 24 as it passes upwardly through the plate 22. The air promotes combustion of the fuel and the flue gases thus formed rise in the enclosure 12 by forced convection and entrain a portion of the solids to form a column of decreasing solids density in the enclosure to a given elevation, above which the density remains substantially constant.

A cyclone separator 26 extends adjacent the enclosure 12 inside the vessel 10 and is connected to the enclosure by a duct 28 extending from an outlet provided in the rear wall 15 of the enclosure to an inlet provided through the separator wall. The separator 26 receives the flue gases and the entrained particulate material from the enclosure in a manner to be described and operates in a conventional manner to disengage the particulate material from the flue gases due to the centrifugal forces created in the separator.

The separated flue gases, which are substantially free of solids enter a duct 30 projecting upwardly through the upper portion of the separator 26 and the vessel 10 for passage into a hot gas clean-up and a heat recovery section (not shown) for further treatment. The lower portion of the separator includes a hopper 26*a* which is connected to a conventional "J-valve" 32 by a dip leg 34.

Figure 5:
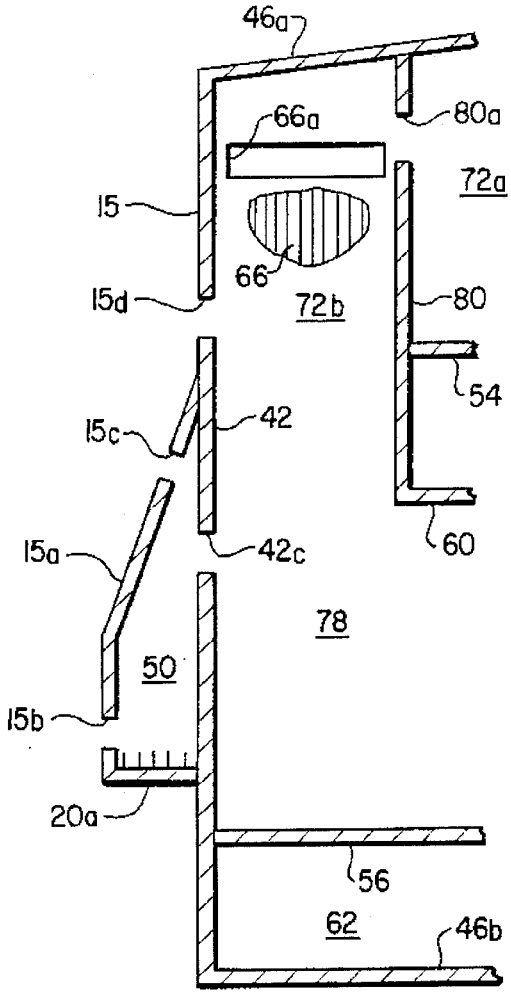
FIG. 5 is a cross-sectional view taken along the line 5—5 of FIG. 3.

A heat exchanger 38 is located adjacent the enclosure 12 and within the vessel 10, and is connected to the outlet of the J-valve 32 by a duct 39. The heat exchanger 38 includes an enclosure 40 formed by a front wall 42, a rear wall 43, two sidewalls 44*a* and 44*b* (FIG. 2), a roof 46*a* and a floor 46*b*. As shown in FIG. 1, the front wall 42 forms a lower extension of that portion of the rear enclosure wall 15 that extends just above the converging portion 15*a*. As shown in FIGS. 1 and 5, the plate 22 extends to the wall 42 to form a solids outlet compartment 50 defined above the latter extension and between the converging portion 15*a* of the enclosure rear wall 15 and the front wall 42 of the enclosure 40.

Figure 2:
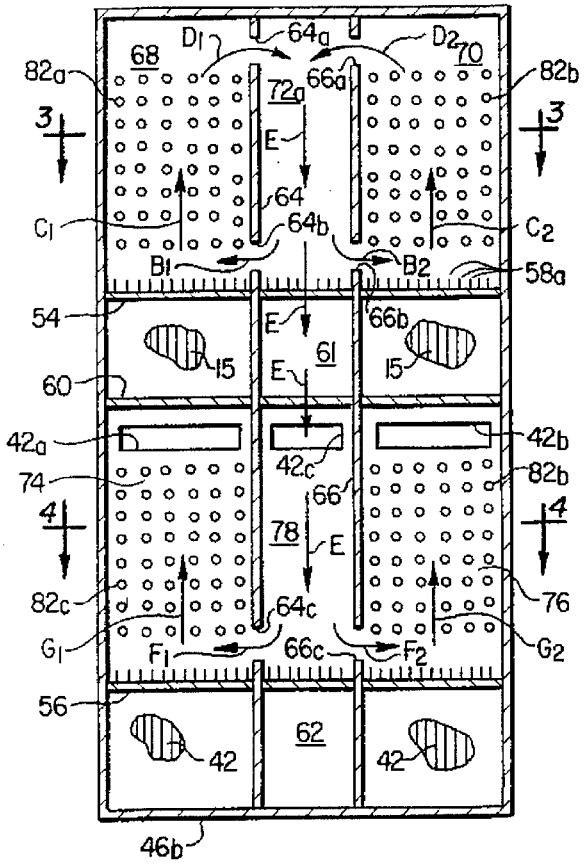
FIG. 2 is a cross-sectional view taken along the line 2—2 of FIG. 1.

Two horizontally-extending, vertically-spaced, plates 54 and 56 (FIGS. 1 and 2) are disposed in the enclosure 40 and receive two groups of air distributor nozzles 58*a* and 58*b*, respectively. A third horizontally-extending plate 60 is disposed in the enclosure 40 and extends between the plates 54 and 56 to generally divide the enclosure into an upper portion and a lower portion. As shown in FIG. 2, a plenum section 61 is defined between the plates 54 and 60 for supplying air to the nozzles 58*a*, and a plenum section 62 is defined between the plate 56 and the floor 46*b* for supplying air to the nozzles 58*b*.

Figure 4:
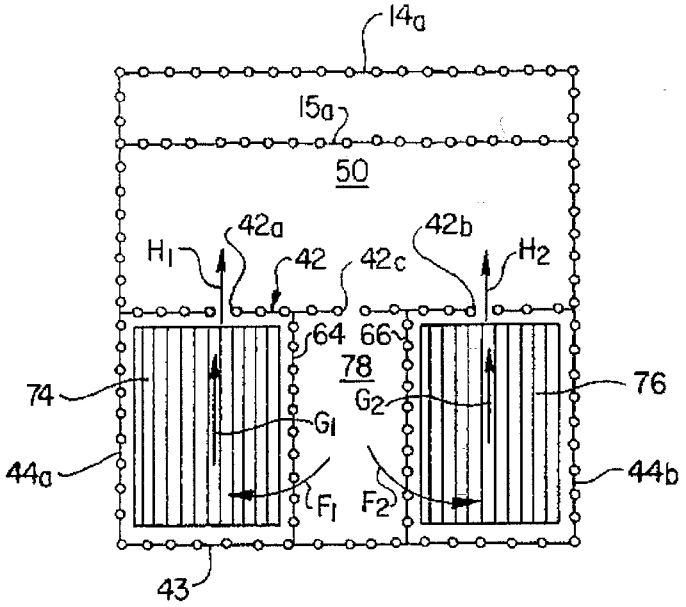

As shown in FIGS. 2 and 3, a pair of spaced, parallel vertical plates 64 and 66 extend between the rear wall 43 of the enclosure 40 and the wall 15 (and the wall 42) in a spaced parallel relationship to the sidewalls 44*a* and 44*b*. The plates 64 and 66 thus divide the upper portion of enclosure 40 into two heat exchange sections 68 and 70, respectively extending to the sides of a inlet/bypass section 72 (FIGS. 2 and 3). The plates 64 and 66 also divide the lower portion of the enclosure 40 into two heat exchange sections 74 and 76 respectively extending to the sides of a bypass section 78 (FIGS. 2 and 4). As shown in FIG. 2, three openings 64*a*, 64*b*, and 64*c* are formed in the plate 64 and three openings 66*a*, 66*b* and 66*c* are formed in the plate 66 to permit the flow of solids between the upper sections 68, 70, and 72, as well as between the lower sections 74, 76 and 78 as will be described.

The plates 64 and 66 also divide the plenum 61 into three sections respectively extending below the sections 74, 76, and 78 and, in addition, divide the plenum 62 into three sections respectively extending below the sections 74, 76, and 78.

It is understood that pressurized air from the vessel 10 is selectively introduced into the aforementioned plenum sections at varying velocities in a conventional manner, for reasons to be described.

As shown in FIG. 3, a vertical partition 80 extends from the horizontal plate 60 (FIG. 2) to the roof 46*a* and divides the inlet/bypass compartment 72 into two sections 72*a* and 72*b*. As shown in FIG. 5, the portion of the plate 54 that defines the compartment 60, as well as the corresponding portion of the plate 60, terminates at the partition 80 and thus do not extend to the wall 15 thus connecting the section compartment section 72*b* with the section 78 for reasons that will be described.

Four bundles 82*a*, 82*b*, 82*c*, and 82*d* of heat exchange tubes (FIGS. 2–4) are disposed in the heat exchange sections 68, 70, 74, and 76, respectively and are connected in a conventional manner to a fluid flow circuit (not shown) to circulate cooling fluid through the tubes to remove heat from the solids in the sections, in a conventional manner.

With reference to FIG. 5, an opening 80*a* is provided in the partition 80, a plurality of openings 42*a* are provided across the wall 42 and an opening 15*b* is provided in the wall 15 and as shown in FIGS. 2 and 5, three spaced openings 42*a*, 42*b* and 42*c* are provided through the wall 42 communicating with the sections 74, 78 and 76, respectively. The opening 80*a* is in the upper portion of the enclosure 40 and the opening 42*a* is at a higher level than the opening 15*b*, for reasons to be described. Also, two optional openings 15*c* and 15*d* can be provided in the upper portion of the wall 15*a* for venting the fluidizing air to the furnace at a higher level than the level of the opening 15*b*, as will be described.

It is understood that all of the foregoing walls, plates and partitions are formed of a conventional welded membrane and tube construction shown and described in U.S. Pat. No. 5,069,171 assigned to the assignee of the present application, the disclosure of which is incorporated by reference. It is also understood that a steam drum is provided adjacent the vessel and a plurality of headers, downcomers and the like are provided to establish a fluid flow circuit including the foregoing tubed walls. Thus, water is passed in a predetermined sequence through this flow circuitry to convert the water to steam by the heat generated by the combustion of the fuel solids in the furnace enclosure 12.

In operation, the solids are introduced into the furnace enclosure 12 in any conventional manner where they accumulate on the plate 20. Air is introduced into the pressure vessel 10 and passes into the plenum 24 and through the plate 20 before being discharged by the nozzles 22 into the solids on the plate 20, with the air being at sufficient velocity and quantity to fluidize the solids.

A lightoff burner (not shown), or the like, is provided to ignite the fuel material in the solids, and thereafter the fuel portions of the solids is self-combusted by the heat in the furnace enclosure 12. The flue gases pass upwardly through the furnace enclosure 12 and entrain, or elutriate, a quantity of the solids. The quantity of the air introduced, via the plenum 24, through the nozzles 22 and into the interior of the enclosure 12 is established in accordance with the size of the solids so that a circulating fluidized bed is formed, i.e., the solids are fluidized to an extent that substantial entrainment or elutriation thereof is achieved. Thus, the flue gases passing into the upper portion of the furnace enclosure are substantially saturated with the solids and the arrangement is such that the density of the bed is relatively high in the lower portion of the furnace enclosure 12, decreases with height throughout the length of this enclosure and is substantially constant and relatively low in the upper portion of the enclosure.

The saturated flue gases in the upper portion of the furnace enclosure 12 exit into the duct 28 and pass into the cyclone separator 26. The solids are separated from the flue gases in the separator 26 in a conventional manner, and the clean gases exit the separator and the vessel 10 via the duct 30 for passage to hot-gas clean-up and heat recovery apparatus (not shown) for further treatment as described in the above-cited patent.

The separated solids in the separator 26 fall into the hopper 26*a* and exit the latter, via the dip leg 34 before passing through the J-valve 32 and, via the duct 39, into the enclosure 40 of the heat exchanger 38.

The separated solids from the duct 39 enter the inlet/bypass compartment section 72*a* of the enclosure 40 as shown by the flow arrow A in FIG. 3. In normal operation, air is introduced at a relatively high rate into the sections of the plenum 61 extending below the heat exchange sections 68 and 70 while air at a relatively low rate is introduced into the section of the plenum extending below the section 72*a*. As a result, the solids from the section 72*a* flow through the openings 64*b* and 66*b* (FIG. 2) in the partitions 64 and 66, respectively, and into the sections 68 and 70, as shown by the flow arrows B1 and B2 in FIGS. 2 and 3. The solids flow under and up through the heat exchange tube bundles 82*a* and 82*b* in the sections 68 and 70, as shown by the arrows C1 and C2 in FIGS. 2 and 3. The solids thus build up in the sections 68 and 70 and spill through the openings 64*a* and 66*a* in the partitions 64 and 66 respectively, into the inlet/bypass compartment section 72*b*, as shown by the flow arrows D1 and D2 in FIGS. 2 and 3. The solids then fall, by gravity through the openings in the plates 54 and 60, respectively, and into the lower section 78, as shown by the flow arrows E in FIG. 2.

Air at a relatively high rate is introduced into the sections of the lower plenum 62 extending below the lower heat exchange sections 74 and 76 while air at a relatively low rate is introduced into the section of the plenum 62 extending below the section 78. This promotes the flow of the solids from the section 78, through the openings 64*c* and 66*c* in the partitions 64 and 66, and into the heat exchange sections 74 and 76, as shown by the flow arrows F1 and F2, respectively, in FIGS. 2 and 4. The solids thus flow up through the tube bundles 82*c* and 82*d* in the sections 74 and 76, respectively, to transfer heat to the fluid flowing through the latter tubes. As shown in FIGS. 4 and 5 by the flow arrows H1 and H2, the solids exit the sections 74 and 76 via openings 42*a* and 42*b*, respectively, in the wall 42 and pass into the outlet compartment 50 where they mix before passing, via openings 15*b* in the lower portion of the wall 15, back into the furnace enclosure 12. The fluidizing air from all of the heat exchange sections 68, 70, 74 and 76 also flows into the furnace enclosure 12 through the openings 42*a* and 15*b*.

Feed water is introduced into, and circulated through, the flow circuit described above including the water wall tubes and the steam drum described above in a predetermined sequence to convert the water to steam and to superheat and reheat (if applicable) the steam.

During low loads, emergency shutdown conditions or start-up, a bypass operation is possible by terminating all air flow into the sections of the plenums 61 and 62 extending below the sections 68, 70, 74 and 76 and thus allowing the solids to build up in the inlet section 72*a* until their level reaches that of the weir port 80*a* in the partition 80, as shown in FIG. 5. Thus, the solids spill over into the section 72*b* of the inlet/bypass compartment 72 and fall down through the openings in the plates 54 and 60 and into the section 78. The solids thus build up in the section 78 until their level reaches that of the opening 42*a* in the wall 42 and enter the outlet compartment 50 before passing, via the opening 15*b*, back to the enclosure 12 at substantially the same temperature as when the solids entered the heat exchanger 38.

By selective control of the respective velocities of the air discharging into the heat exchange sections 68, 70, 74 and 76, the respective heat exchange with the fluid passing through the walls and partitions of the enclosure 40 can be precisely regulated and varied as needed. For example, in the bypass operation described above, instead of completely defluidizing the sections 68, 70, 74 and 76 and thus allowing all of the solids to bypass through the sections 72*b* and 78 as described above, the sections 68, 70, 72*a*, 74 and 76 can be partially fluidized so that only a portion of the solids bypass directly through the sections 72*b* and 78, and thus pass directly into the enclosure 12. The remaining portion of the solids would thus pass in the standard manner through one or more of the sections 68, 70, 74 and 76 to remove heat therefrom, as described above, resulting in less heat removal from the solids when compared to the standard operation described above in which all of the solids pass through the sections 68, 70, 74 and 76. Also, the fluidization could be varied so that the solids bypass one of the sections 68 and 70 as described in the bypass operation, above, and pass through the other as well as bypass one of the sections 74 and 76 and pass through the other. Moreover, during the standard operation, the fluidization, and the resulting heat removal, can be varied between the sections 68 and 70 and between the section 74 and 76, especially if these sections perform different functions (such as superheat, reheat, and the like). For example, the respective fluidization can be controlled so that 70% of the solids pass through the section 68 and 30% pass through the section 70 and so that 60% of the solids pass through the section 74 and 40% pass through the section 76, with these percentages being variable in accordance with particular design requirements.

In addition to providing the flexibility of operation discussed above, the present invention enjoys several other advantages. For example, a significant amount of heat can be removed from the solids circulating through the recycle heat exchanger 38 to maintain the desired temperature within the furnace for optimum fuel burn-up and emissions control. Also, the aforementioned selective fluidization, including the bypass modes, is done utilizing non-mechanical techniques. Moreover, the use of a pressurized system enables the separator to be relatively small, thus making room for the stacked heat exchange sections in the enclosure 40 to minimize the pressure vessel diameter.

It is understood that several variations can be made in the foregoing without departing from the scope of the invention. For example, an optional opening 15*c* can be provided in the wall 15*a* which permits the fluidizing air from all of the heat exchange sections 68, 70, 74 and 76 to be vented into the furnace enclosure instead of through the opening 15*b* with the solids. This venting of the air through the opening 15*c* would enable the air to enter the furnace at a higher level and function as secondary air. In this arrangement, the solids would still be returned to the enclosure 12 through the opening 15*b* but would be allowed to build up to a sufficient level to balance the pressure difference between the openings 15*b* and 15*c*. According to another arrangement, the openings 42*c* would be eliminated and an opening 15*d* would be provided in the lower portion of the well 15. As a result, the solids and the fluidizing air from the upper sections 68, 70, and 72 would be discharged through the opening 15*d*. The level of the solids in the section 78 would thus be sufficient to balance pressure, and the fluidizing air from the outlet compartment 50 would vent to the furnace through openings 15*b* (or 15*c*). With this arrangement, and especially the elimination of the opening 42*c*, the ability to bypass the lower sections 74 and 76 is eliminated and the amount of air returning to the lower furnace is reduced. Thus, this arrangement can be applied to designs that have economizer or steam generating tube coils in sections 74 and 76 which do not need the bypass capability for protection from overheating.

It is also understood that the number and location of the various other openings in the walls of the enclosures 12 and 40 can be varied, and more than one separator can be utilized. Further, although the present invention has been described in connection with a pressurized fluidized bed boiler, it is understood that it is equally applicable to an atmospheric fluidized bed boiler. Examples of the latter are fully disclosed in U.S. Pat. Nos. 5,133,943 and No. 5,140950, both assigned to the assignee of the present invention. Further, although a J-valve 32 was utilized in the preferred embodiment described above, it is understood that it could be replaced with another type of pressure sealing device within the scope of the invention. Examples of pressure sealing devices that would be applicable in this context are an L-valve, a seal pot, an N-valve or any other non-mechanical sealing device. Finally, although the preferred embodiment described above utilized two upper heat exchange sections 68 and 70 and two lower heat exchange sections 74 and 76, it is within the scope of the present invention to vary the number of these sections. Thus, in smaller systems one upper and/or lower heat exchange section can be used while larger systems may employ three or more.

Other variations in the present invention are contemplated and in some instances, some features of the invention can be employed without a corresponding use of other features. Accordingly, it is appropriate that the appended claims be construed broadly in a manner consistent with the scope of the invention.

What is claimed is:

1. A fluidized bed combustion method comprising the steps of providing a furnace and a heat exchanger adjacent said furnace, fluidizing a bed of combustible material in said furnace, discharging a mixture of flue gases and entrained material from said furnace, separating said entrained material from said flue gases, passing said separated flue gases to a heat recovery section, passing said separated material into an inlet section of said heat exchanger, passing said separated material from said inlet section to a heat exchange section, introducing air into said heat exchange section to fluidize said separated material, passing said separated material and said air to an outlet section of said heat exchanger and separately discharging said separated material and said latter air from said outlet section to said furnace.

2. A fluidized bed combustion system comprising a furnace, means for establishing a fluidized bed containing particulate material including fuel in said furnace whereby flue gases produced as a result of combustion of said fuel entrain a portion of said particles, means for separating said entrained particles from said flue gases, a heat exchanger disposed adjacent said furnace for receiving said separated particles, said heat exchanger comprising a first series of compartments including a first inlet compartment for receiving said separated particles, a first additional compartment disposed adjacent said first inlet compartment and a first outlet compartment disposed adjacent said first additional compartment, a second series of compartments extending underneath said first series of compartments and including a second inlet compartment, a second additional compartment disposed to the side of said second inlet compartment and a second outlet compartment disposed to the side of said second inlet compartment, first heat exchange means associated with said first additional compartment and second heat exchange means associated with said second additional compartment, first passage means connecting said first inlet compartment with said first additional compartment to enable said separated particles to pass to said first additional compartment to exchange heat with said first heat exchange means, second passage means connecting said first additional compartment with said first outlet compartment to enable said separated particles to pass from said first additional compartment to said first outlet compartment, third passage means connecting said first outlet compartment with said second inlet compartment to permit said separated particles to pass from said first outlet compartment to said second inlet compartment, fourth passage means connecting said second inlet compartment to said second additional compartment to enable said separated particles to pass from said second inlet compartment to said second additional compartment to exchange heat with said second heat exchange means, and fifth passage means connecting said second additional compartment to said second outlet compartment to enable said separated particles to pass from said second additional compartment to said second outlet compartment, and sixth passage means connecting said second outlet compartment to said furnace to permit said separated particles to pass from said second outlet compartment to said furnace.

3. The system of claim 2 further comprising an additional compartment in said first series of compartments and disposed adjacent said first inlet compartment, heat exchange means disposed in said latter additional compartment, passage means connecting said first inlet compartment to said latter additional compartment to enable a portion of said separated particles to pass from said first inlet compartment to said latter additional compartment to exchange heat with said latter heat exchange means, passage means connecting said latter additional compartment to said first outlet compartment to permit said portion of said separated particles to pass from said latter additional compartment to said first outlet compartment.

4. The system of claim 2 further comprising an additional compartment in said second series of compartments and disposed adjacent said second inlet compartment, heat exchange means disposed in said latter additional compartment, passage means connecting said second inlet compartment to said latter additional compartment to enable a portion of said separated particles to pass from said second inlet compartment to said latter additional compartment to exchange heat with said latter heat exchange means, passage means connecting said latter additional compartment to said second outlet compartment to permit said portion of said separated particles to pass from said latter additional compartment to said second outlet compartment.

5. The system of claim 2 further comprising passage means directly connecting said first inlet compartment to said first outlet compartment to enable said separated particles to pass directly from said first inlet compartment to said first outlet compartment in response to the height of said separated particles in said first inlet compartment exceeding a predetermined height.

6. A fluidized bed combustion system comprising a furnace section; a heat exchange section adjacent said furnace section; means for supporting a bed of particulate material in each of said sections; means for introducing air into said furnace section for fluidizing said material in said furnace section, a separating section for receiving a mixture of flue gases and entrained particulate material from the fluidized bed in said furnace section and separating said entrained particulate material from said flue gases; a heat recovery section for receiving said separated flue gases; means for passing said separated material from said separating section to said heat exchange section; said heat exchange section comprising an enclosure, means for dividing said enclosure into an inlet section for receiving said separated material from said passing means, at least one heat exchange section, and an outlet section, means for connecting said inlet section to said heat exchange section for passing said separated material from said inlet section to said heat exchange section, means for introducing air to said heat exchange section to fluidize the material in said heat exchange section, means for connecting said heat exchange section to said outlet section for passing said separated material and said air from said heat exchange section to said outlet section, and means for connecting said outlet section to said furnace section for passing said separated material and said latter air from said outlet section to said furnace section, said outlet section including a first opening for discharging said separated material into said furnace and a second opening for discharging said latter air into said furnace section.

7. The system of claim 6 wherein said first opening is lower than said second opening for promoting said discharge of said separated material and said latter air through said first and second openings, respectively.

8. The system of claim 6 further comprising means for connecting said inlet section to said outlet section for bypassing said heat exchange section.

* * * * *